US008513745B2

(12) United States Patent
Steeneken et al.

(10) Patent No.: US 8,513,745 B2
(45) Date of Patent: Aug. 20, 2013

(54) MEMS SWITCH AND FABRICATION METHOD

(75) Inventors: Peter Gerard Steeneken, Valkenswaard (NL); Hilco Suy, Hulst (NL); Martijn Goossens, Veldhoven (NL); Olaf Wunnicke, Eindhoven (NL)

(73) Assignee: NXP B.V., Eindhoven (NL)

( * ) Notice: Subject to any disclaimer, the term of this patent is extended or adjusted under 35 U.S.C. 154(b) by 310 days.

(21) Appl. No.: 12/996,505

(22) PCT Filed: May 29, 2009

(86) PCT No.: PCT/IB2009/052272

§ 371 (c)(1), (2), (4) Date: Dec. 8, 2010

(87) PCT Pub. No.: WO2009/147600

PCT Pub. Date: Dec. 10, 2009

(65) Prior Publication Data

US 2011/0147861 A1 Jun. 23, 2011

(30) Foreign Application Priority Data

Jun. 6, 2008 (EP) ..... 08104294

(51) Int. Cl.
*H01L 29/84* (2006.01)

(52) U.S. Cl.
USPC ..... 257/415; 257/417; 257/E29.166

(58) Field of Classification Search
USPC ..... 257/415, 417, E21.499, E29.166; 438/50–52
See application file for complete search history.

(56) References Cited

U.S. PATENT DOCUMENTS

| | | | | |
|---|---|---|---|---|
| 6,100,477 | A | 8/2000 | Randall et al. | |
| 2001/0023523 | A1 | 9/2001 | Kubby et al. | |
| 2001/0040250 | A1 | 11/2001 | Charrier et al. | |
| 2002/0096488 | A1 | 7/2002 | Gulvin et al. | |
| 2003/0011955 | A1 | 1/2003 | Murphy | |
| 2007/0268095 | A1 * | 11/2007 | Chou | 333/262 |

FOREIGN PATENT DOCUMENTS

| | | | |
|---|---|---|---|
| EP | 1798745 | A2 | 6/2007 |
| WO | 96/38850 | A1 | 12/1996 |
| WO | 2005/104717 | A2 | 11/2005 |

OTHER PUBLICATIONS

Wong, et al., "An electrostatically-actuated MEMS switch for power applications", Proc. IEEE MEMS 2000, p. 633 (2002).
Chrusch, et al., "Corrugated Micromachined Membrane Structures," Proceedings of the 2002 IEEE Canadian Conference on Electrical & Computer Engineering, pp. 445-449 (2002).

(Continued)

*Primary Examiner* — Chuong A Luu
*Assistant Examiner* — Nga Doan

(57) ABSTRACT

A MEMS switch (1, 81), and methods of fabricating thereof, the switch comprising: a sealed cavity (24); and a membrane (26); wherein the sealed cavity (24) is defined in part by the membrane (26); and the membrane is a 5 metallic membrane (26), for example consisting of a single type of metal or metal alloy. The MEMS switch (1, 81) may comprise a top electrode (30), for example extending into the cavity (24), located in a hole (32) in the metallic membrane (26). Fabrication may include providing a sacrificial layer (22) in a partly defined cavity (24). The bending stiffness of the membrane (26) may be 10 higher along an RF line (102) than along a line (104) perpendicular to the RF line (102), for example by virtue of the cavity (24) being elliptical.

20 Claims, 15 Drawing Sheets

(56) References Cited

OTHER PUBLICATIONS

Nieminen H et al., "Microelectromechanical capacitors for RF applications", Journal of Micromechanics and Microengineering, vol. 12 pp. 177-186 (2002).

Frederico S. et al., "Silicon sacrificial layer dry etching (SSLDE) for free standing RF MEMS architectures", Proceedings of the IEEE 16th Annual Conference on Microelectr mechanical Systems, pp. 570-573 (2003).

McFeetors G. and Okoniewski M., "Custom fabricated high-Q analogue dual-gap RF MEMS varactors", IEEE International Conference on Microwaves, Radar and Wireless Communications, MIKON 2006, pp. 155-158 (2006).

International Search Report and Written Opinion, for Application No. PCT/IB2009/052272, Aug. 2009.

* cited by examiner

MEMS SWITCH AND FABRICATION METHOD

The present invention relates to MEMS switches and the fabrication thereof. The present invention is particularly suited to, but not limited to, galvanic MEMS switches including electrostatic actuated galvanic MEMS switches and galvanic (RF) MEMS switches.

Micro Electro Mechanical System (MEMS) devices are known. One type of known MEMS device is a galvanic (RF) MEMS switch in which an electrostatic force is applied across the switch to actuate it by deflecting a moving structure or membrane such that a part of the membrane makes electrical contact with a contact electrode within the device. Such switches have a wide range of potential applications, for example, telecommunications or power applications.

In "an electrostatically-actuated MEMS switch for power applications", Jo-Ey Wong, Jeffrey H. Lang, Martin A. Schmidt, Proc. IEEE MEMS 2000, p. 633, a MEMS switch is disclosed which employs a two-wafer stack structure with a circular LPCVD silicon nitride diaphragm as the moving structure.

Typical manufacturing requirements for galvanic (RF) MEMS switches include small size, mass-produciblility, high reliability and good energy efficiency. There is a general need to balance the requirement for low resistance contacts with the requirement to prevent sticking and arcing of the switch by ensuring that the actuating mechanism has sufficient restoring force to return the switch to its unactuated state once the contact force is removed. In order to achieve this, electrostatically actuated devices typically require that the moving structure have a relatively large area and that the separation gap between the moving structure and the corresponding actuation electrode is relatively small. In the past this requirement has posed fabrication difficulties.

Quite separate from the field of MEMS switches, Proceedings of the 2002 IEEE Canadian Conference on Electrical & Computer Engineering, pages 445-449, Dwayne D. Chrusch and C. Shafai, "Corrugated Micromachined Membrane Structures", discloses varying the spring constant of membranes using corrugations.

The present inventors have realised it would be desirable to provide a reliable compact galvanic (RF) MEMS switch with a simple structure that is more easy to manufacture than typical known switches. The present inventors have also realised it would be desirable to provide a compact galvanic (RF) MEMS switch with a low contact resistance and a small electrostatic gap. The present inventors have also realised it would be desirable to provide an electrostatic actuated galvanic (RF) MEMS switch with an improved trade off in terms of switch size against switch reliability. The present inventors have also realised it would be desirable to provide a switch in which the force required to restore the switch to its unactuated state does not give rise to plastic deformations of the switch.

In a first aspect, the present invention provides a MEMS switch comprising: a sealed cavity; and a membrane; wherein the sealed cavity is defined in part by the membrane; and the membrane is a metallic membrane.

The metallic membrane may consist of a single type of metal or metal alloy.

The metallic membrane may be corrugated.

The MEMS switch may further comprise a top electrode located in a hole in the metallic membrane.

The top electrode may extend into the cavity.

The cavity may be circular.

The MEMS switch may be a galvanic MEMS switch.

The bending stiffness of the metallic membrane may be higher along an RF line than along a line perpendicular to the RF line. This may be by virtue of the cavity being elliptical.

In a further aspect, the present invention provides a method of fabricating a MEMS switch, the method comprising: providing a sealed cavity; and providing a membrane; wherein the sealed cavity is defined in part by the membrane; and the membrane is a metallic membrane.

The method may further comprise providing a top electrode located in a hole in the metallic membrane.

In a further aspect, the present invention provides a method of fabricating a MEMS switch, the method comprising: providing a substrate; providing one or more layers defining in part a cavity; providing a sacrificial layer in the partly defined cavity; providing, over the sacrificial layer, to further define the cavity, a metallic membrane in which there is a hole; removing the sacrificial layer from the cavity by etching through the hole in the metallic membrane; and sealing the cavity by sealing the hole.

The step of sealing the hole may comprise sealing the hole with material that provides a top electrode for the MEMS switch.

The method may further comprise: prior to the sealing step, depositing, through the hole, contact material on to a contact provided on the opposite side of the cavity, the depositing step thereby using the metallic membrane as a mask.

In each of the above further method aspects, the metallic membrane may consist of a single type of metal or metal alloy.

In each of the above further method aspects, the metallic membrane may be corrugated. The corrugations in the metallic membrane may be provided by varying the thickness of the sacrificial layer in the step of providing the sacrificial layer.

In each of the above further method aspects, the top electrode may extend into the cavity.

In each of the above further method aspects, the cavity may be circular.

In each of the above further method aspects, the MEMS switch may be a galvanic MEMS switch.

In each of the above further method aspects, the bending stiffness of the metallic membrane may be higher along an RF line than along a line perpendicular to the RF line. This may be by virtue of the cavity being elliptical.

In a further aspect, the present invention provides a MEMS switch, comprising: a membrane clamped at its outer perimeter; an RF line; and an actuation electrode at at least two sides of the RF line; wherein the bending stiffness of the membrane is higher along the RF line than along a line perpendicular to the RF line.

The bending stiffness of the membrane may be higher along the RF line than along the line perpendicular to the RF line by virtue of the outer perimeter of the membrane being elliptical.

Embodiments of the present invention will now be described, by way of example, with reference to the accompanying drawings, in which.

Figure 1:
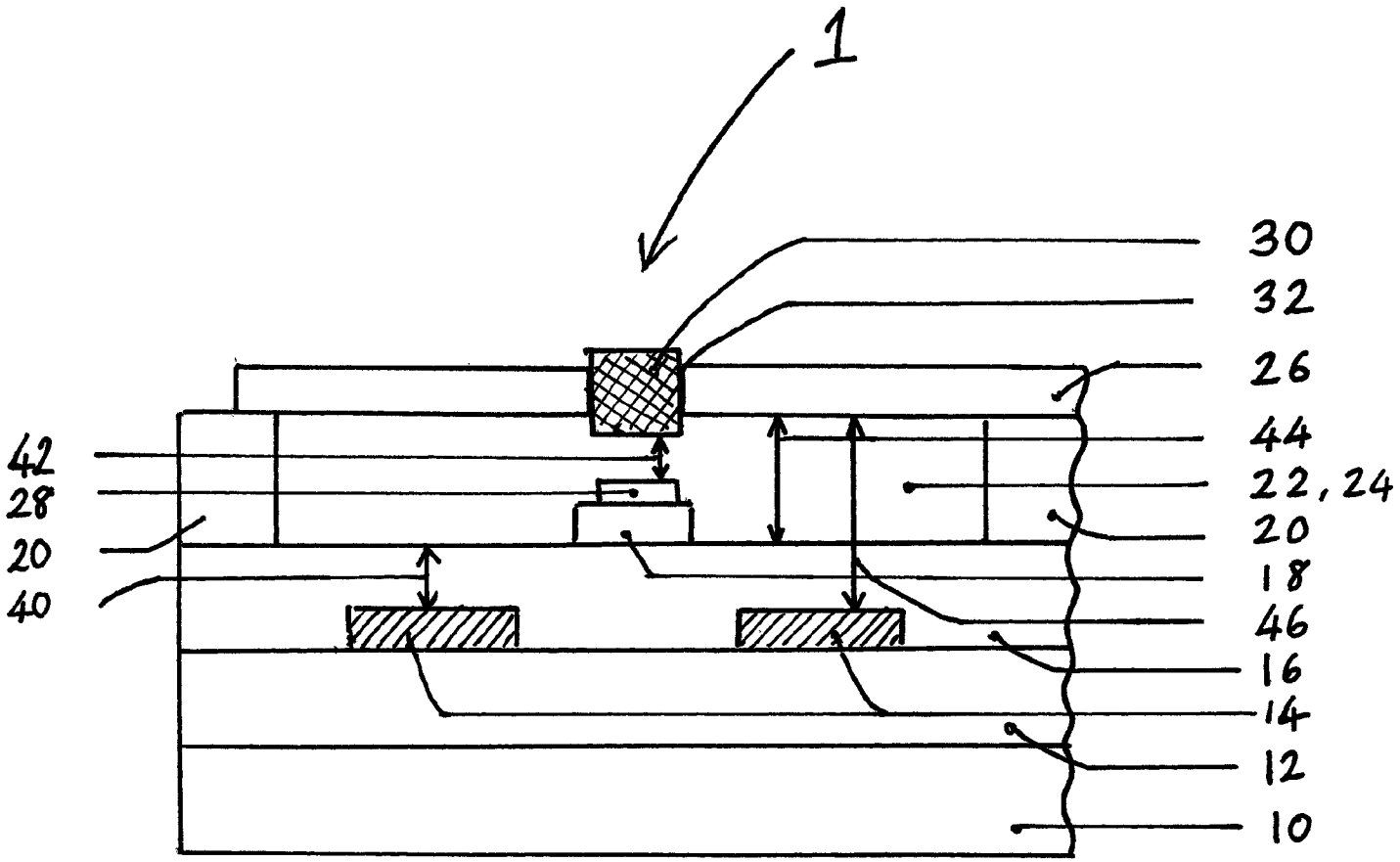
FIG. 1 is a schematic cross section (not to scale) of a galvanic (RF) MEMS switch 1.
Figure 7:
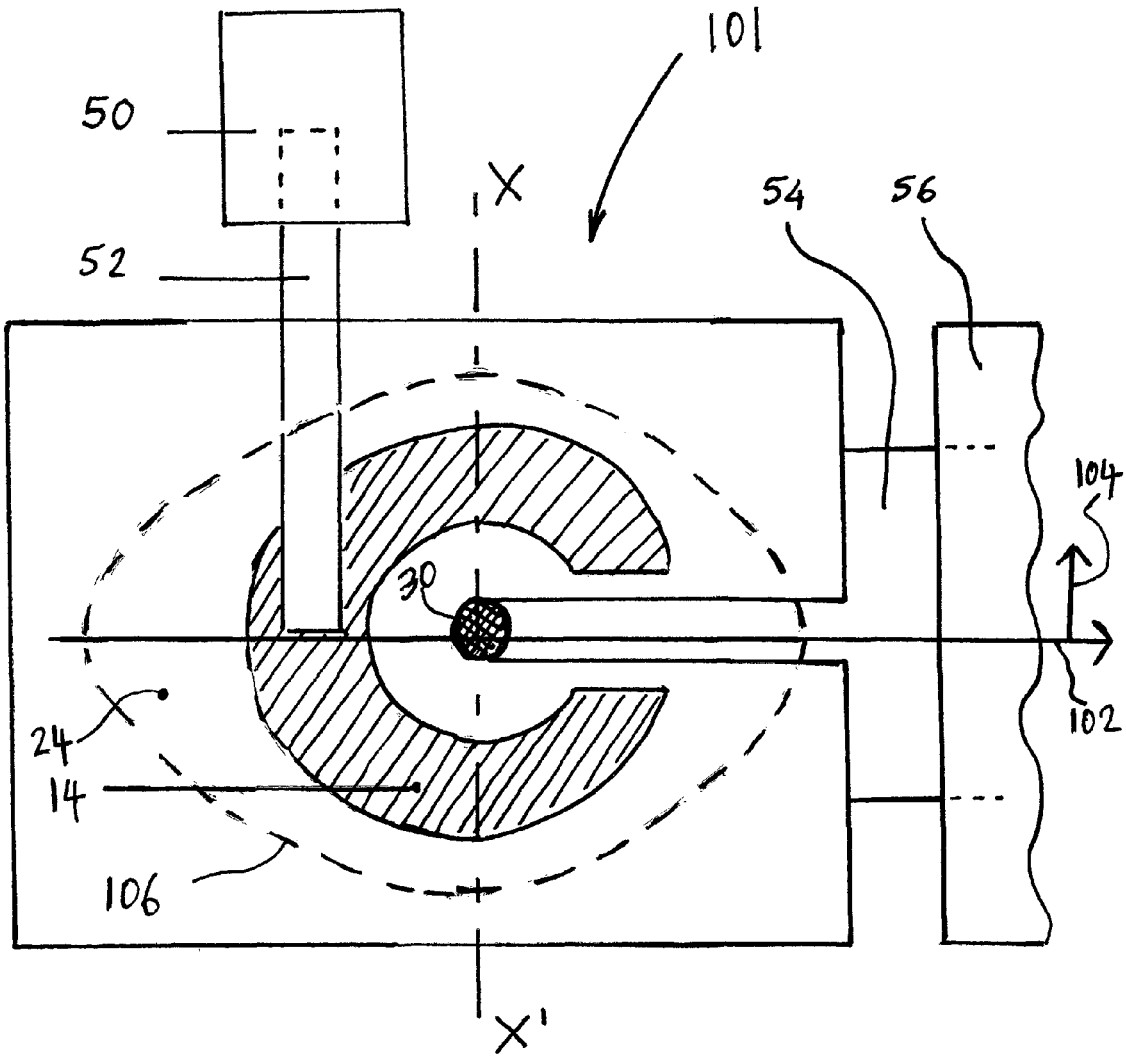
Figure 8:
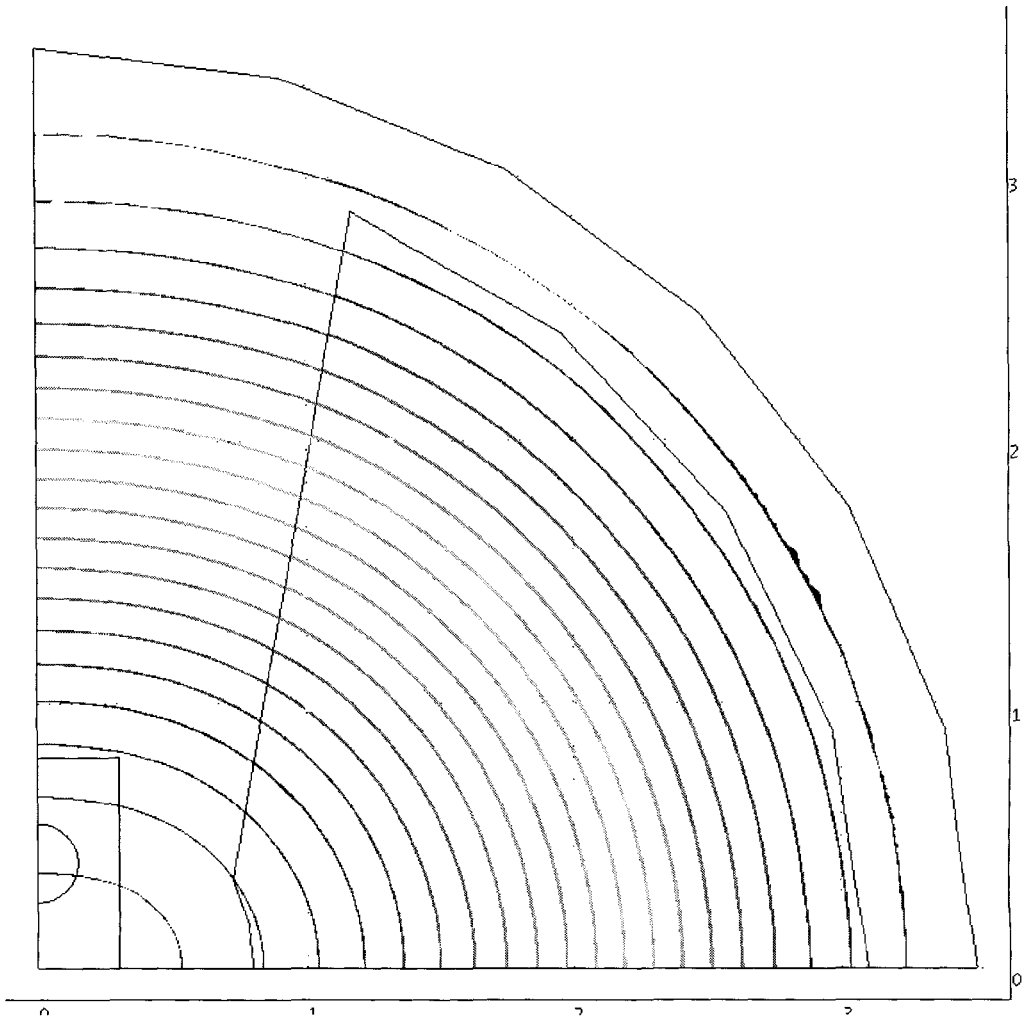
Figure 9:
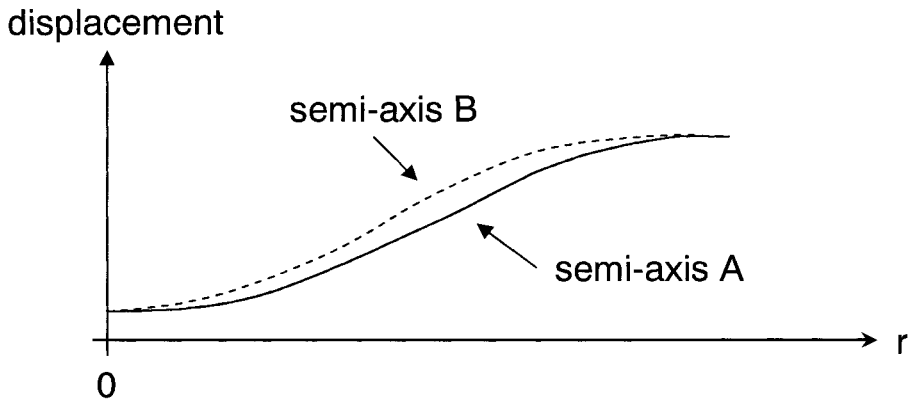
Figure 10:
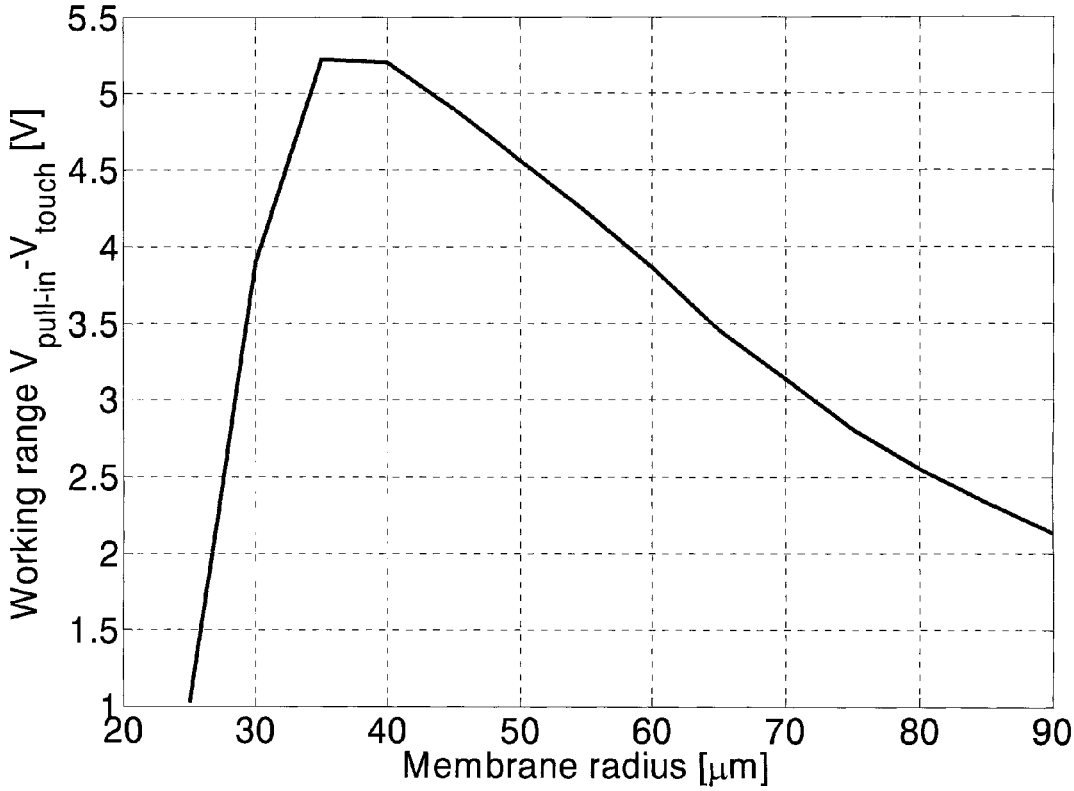
Figure 11:
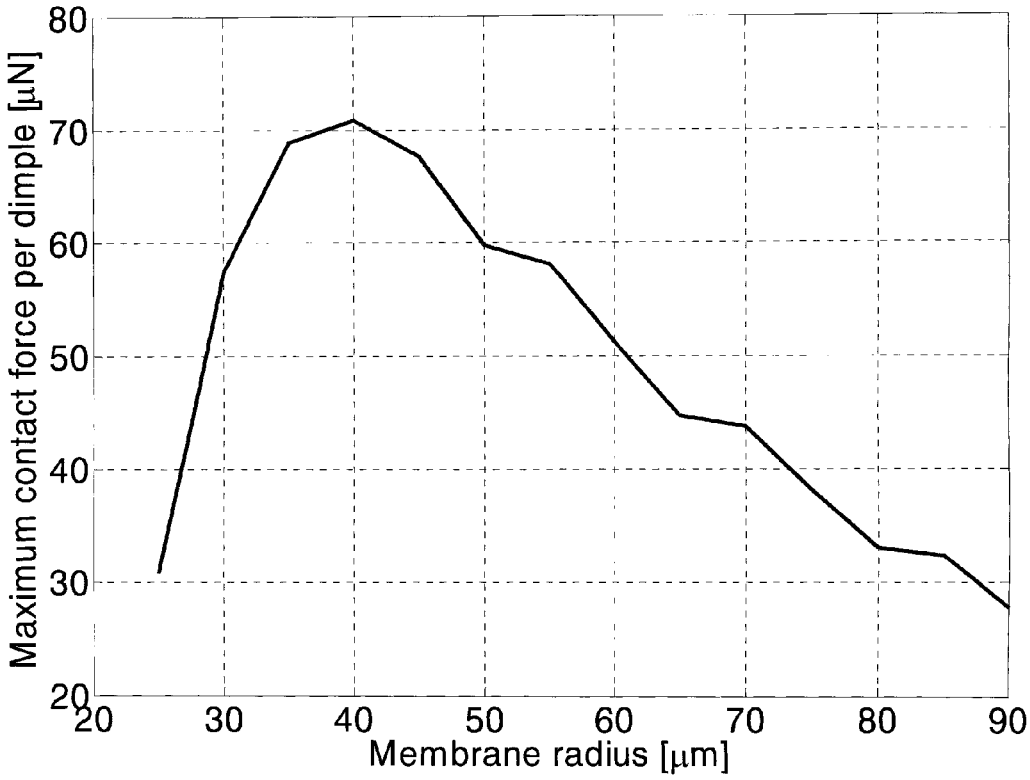
Figure 12:
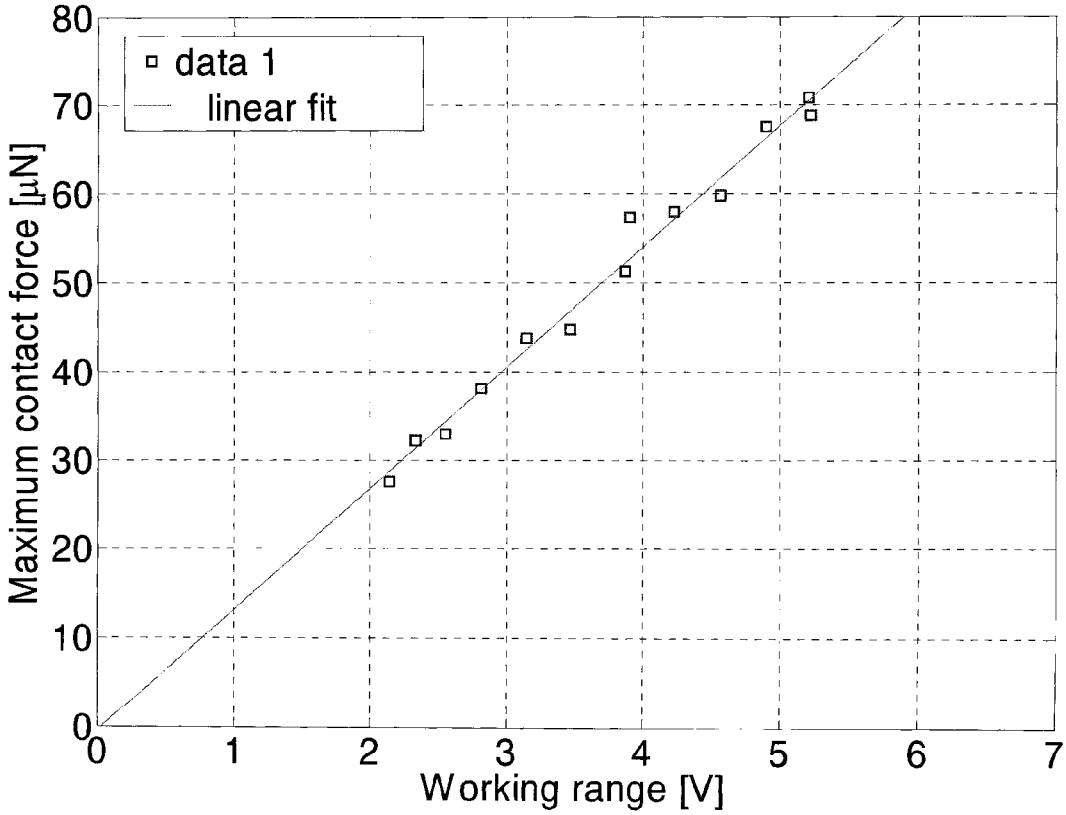
Figure 13:
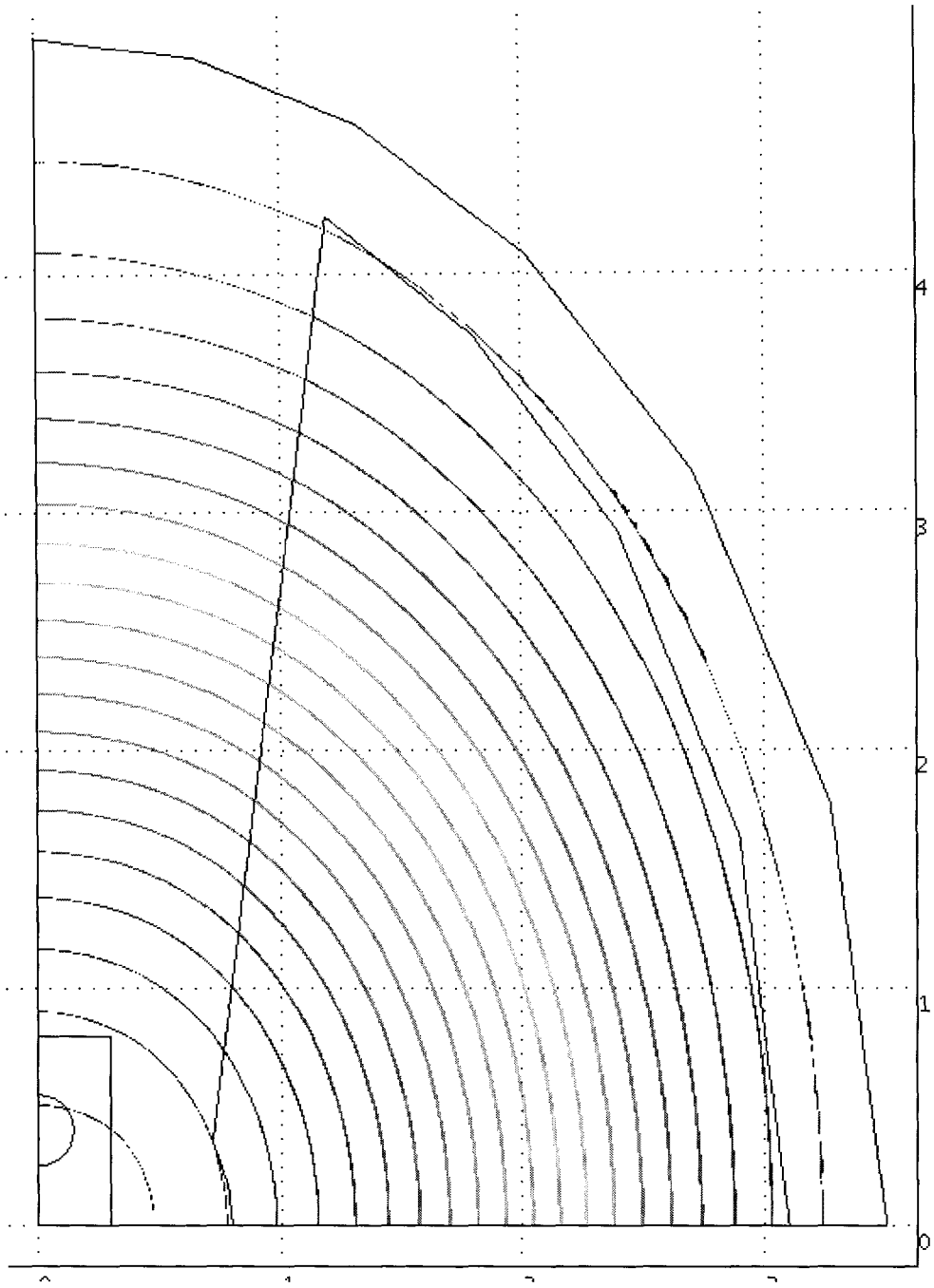
Figure 14:
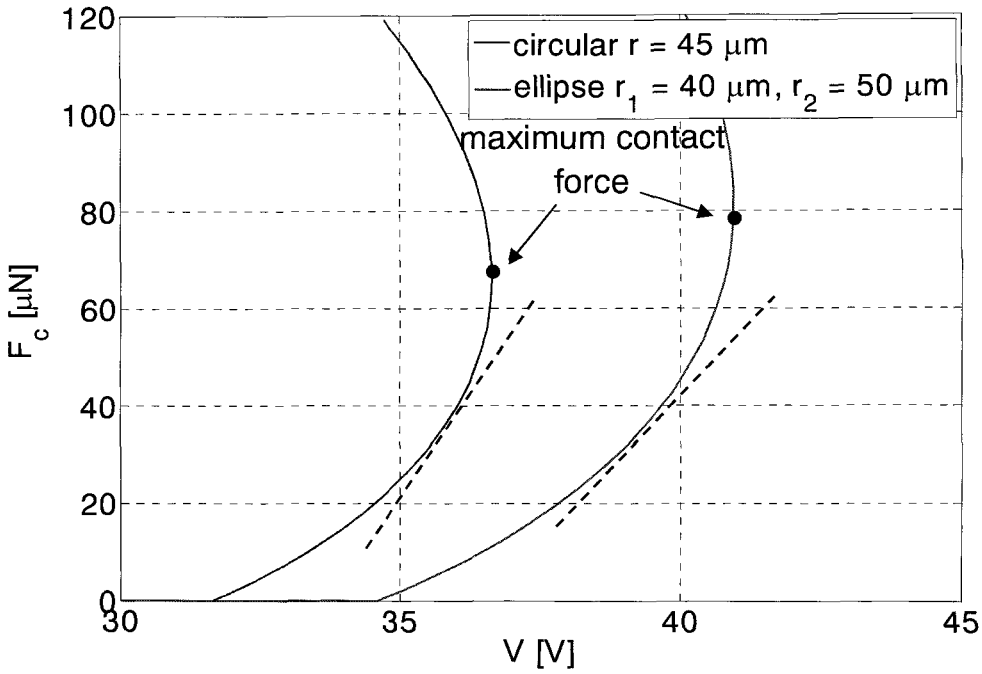
Figure 15:
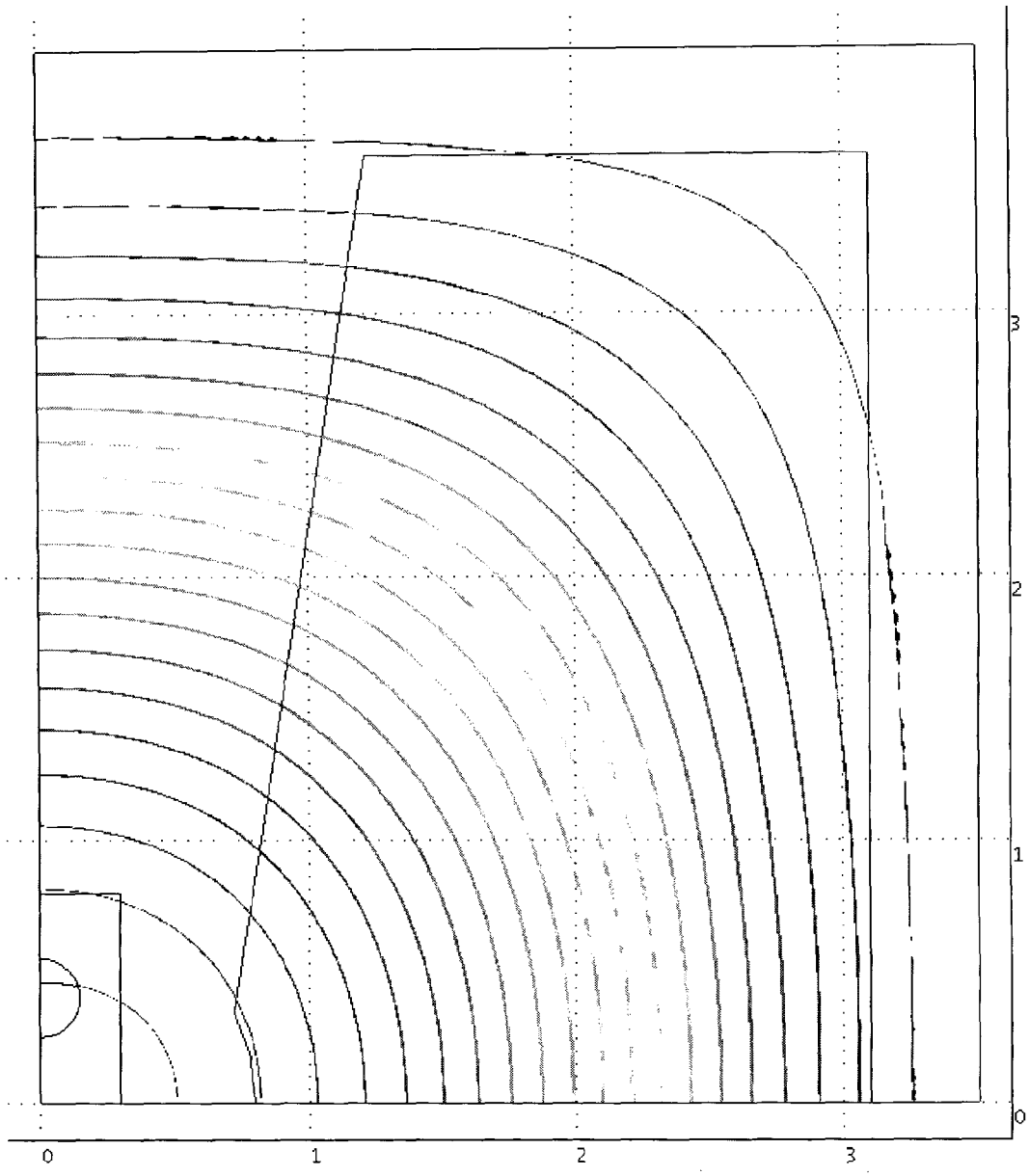

FIG. 7 which is a schematic plan view (not to scale) of an MEMS switch of a further embodiment;

FIG. 8 is a top view of a finite element model of MEMS switches such as that of FIG. 1 at touch-down (quarter symmetry is used);

FIG. 9 is a schematic representation of the displacement along the semi-axes of FIG. 8;

FIG. 10 shows the working range as a function of the membrane radius;

FIG. 11 shows the contact force just before pull-in;

FIG. 12 shows a plot of the maximum contact force against the working range;

FIG. 13 shows a top view of a finite element model of an embodiment, of a switch that has an elliptically shaped membrane, at touch-down (quarter symmetry is used);

FIG. 14 shows contact force $F_c$ (per dimple) as a function of the actuation voltage V for a circular and elliptical membrane; and FIG. 15 is a top view of a finite element model of an embodiment of a rectangular galvanic MEMS switch at touch-down (quarter symmetry is used).

FIG. 1 is a schematic cross section (not to scale) of a first embodiment of a galvanic (RF) MEMS switch 1. The MEMS switch 1 comprises a substrate 10, an isolating layer 12 and an actuation electrode 14. The MEMS switch 1 further comprises a first dielectric layer 16 provided over the activation electrode 14 and the isolating layer 12, and a contact electrode 18 provided on the first dielectric layer 16. A second dielectric layer 20 is provided at the outer edges of the device on the first dielectric layer 16. The contact electrode 18 is positioned centrally with respect to actuation electrode 14. Additional contact material 28 is provided on the contact electrode 18 in the form of a metallic dimple 28 positioned over the contact electrode 18.

The MEMS switch 1 further comprises a metallic membrane 26 positioned over the second dielectric layer 20 and the contact electrode 18 thereby forming a cavity 24. The cavity 24 lies between the metallic membrane 26, the first dielectric layer 16 and the second dielectric layer 20 and surrounds contact electrode 18.

A hole 32 is provided within the metallic membrane 26. The hole 32 is filled with metallic material. The metallic material filling the hole 32 forms a top electrode 30. The top electrode 30 is positioned directly above and spaced apart from the contact electrode 18.

The membrane is made of metal or metal alloy, hence the electrical resistance of the switch is reduced compared to prior art membranes. Furthermore the membrane consists of a single material i.e. a layer of a single type of metal or metal alloy, which therefore has a single coefficient of expansion, thereby alleviating potential problems at high temperatures caused by differences in the thermal expansion co-efficient.

It should be noted that terminology such as top, over and above are used for the purposes of explaining the features of the present embodiment in accordance with the illustration and are not intended to limit the orientation of the device.

Also indicated in FIG. 1 are the following dimensions which will be discussed in more detail later below: the height (indicated in FIG. 1 by reference numeral 40) of the portion of the first dielectric layer 16 above the actuation electrode 14; the height (indicated in FIG. 1 by reference numeral 42) between the lower surface of the top electrode 30 and the top surface of the additional contact material 28 on the contact electrode 18; and the height (indicated in FIG. 1 by reference numeral 44) of the cavity 24 between the metallic membrane 26 and the first dielectric layer 16.

Figure 2:
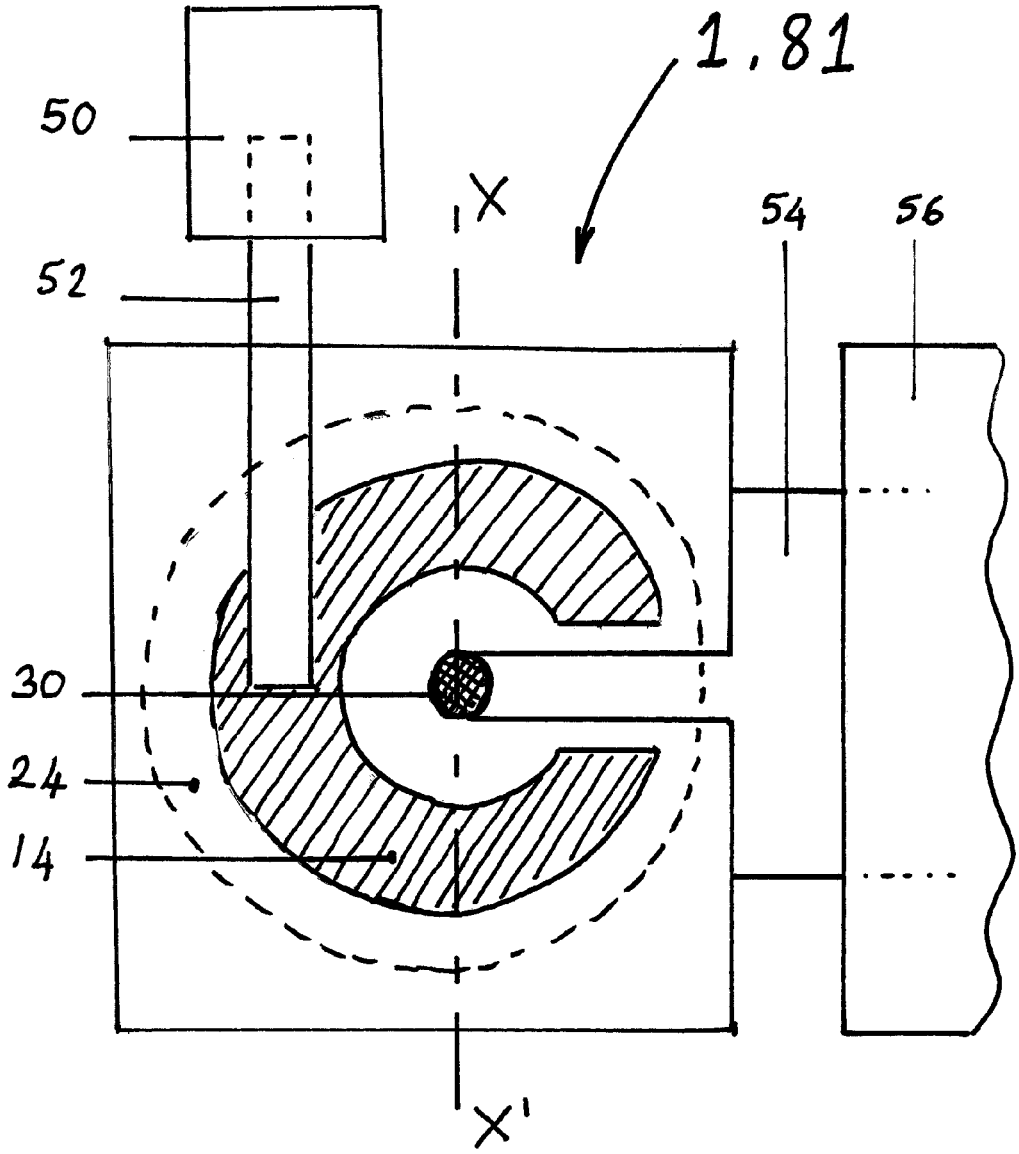
FIG. 2 is a schematic plan view (not to scale) of the MEMS switch of FIG. 1 illustrating the line X-X' along which the cross-section of FIG. 1 was taken.

As is shown in more detail in FIG. 2, in the MEMS switch 1 shown in FIG. 1, the actuation electrode 14, the contact area of the top electrode 30 and the cavity 24 each have a circular form. The metallic membrane 26 is sealed by the second dielectric layer 20 around the circumference of cavity 24 forming a circular diaphragm which acts as the moving structure of the MEMS switch 1.

FIG. 2 is a schematic plan view (not to scale) of the MEMS switch 1 of FIG. 1 illustrating the line X-X' along which the cross-section of FIG. 1 was taken. FIG. 2 shows the following features already shown in FIG. 1: the actuation electrode 14, the cavity 24, the metallic membrane 26 and the top electrode 30. As can be seen from FIG. 2, the actuation electrode 14 is a single structure. The line X-X' along which the cross section of FIG. 1 was taken intersects the actuation electrode 14 twice. Thus FIG. 1 illustrates two cross section portions of the same single structure actuation electrode 14. Other features of FIG. 1 are not shown for the sake of the clarity of the drawing, but should be understood to be present.

FIG. 2 also shows the following further features: actuation voltage contact pad 50, an actuation voltage connector 52, a power output connector 54 and a power output contact pad 56.

The actuation contact pad 50 is connected to the actuation voltage connector 52. The actuation voltage connector 52 is also connected to the actuation electrode 18. The top electrode 30 is connected to the power output connector 54. The power output connector 54 is also connected to the power output contact pad 56. The MEMS switch 1 further comprises a power input connector (not shown). The power input connector is connected to the metallic membrane 26. The voltage difference between the actuation electrode 14 and the metallic membrane 26 results in an electrostatic force which is used to close the switch. By reducing this voltage difference to zero the switch can be opened.

Figure 3:
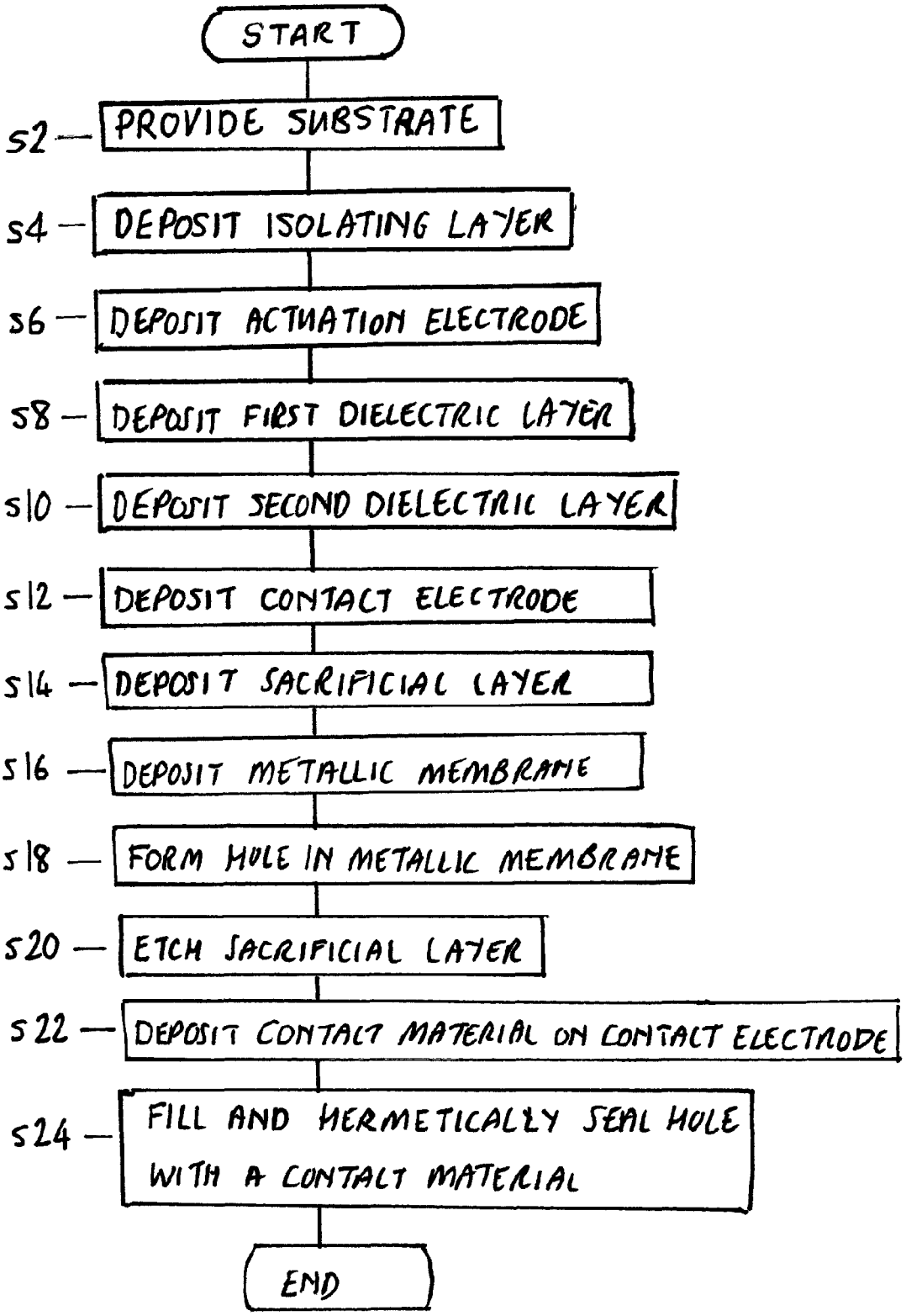
FIG. 3 is a process flow chart showing certain process steps carried out in a fabrication process for fabricating the MEMS switch of FIG. 1.

FIG. 3 is a process flow chart showing certain process steps carried out in an embodiment of a fabrication process for fabricating the above MEMS switch 1.

At step s2, the substrate 10 is provided.

At step s4, the isolating layer 12 is deposited onto the substrate 10. In this embodiment, the thickness of the isolating layer 12 is 100 nm.

At step s6, the actuation electrode 14 is deposited onto the isolating layer 12. The two cross-section portions of the actuation electrode 14 are each typically 15 micron wide.

At step s8, the first dielectric layer 16 is deposited onto the actuation electrode 14. The height 40 of the portion of the first dielectric layer 16 above the actuation electrode 14 is, in this embodiment, 400 nm.

At step s10, the second dielectric layer 20 is deposited onto the first dielectric layer 16 at the outer edges of the MEMS switch 1. The width of the area between the areas of deposition of the second dielectric layer 20 is in the order of 50 micron.

The isolating layer 12 and the dielectric layers 16, 20 may comprise any suitable insulating material such as SiO or SiN.

At s12, the contact electrode 18 is deposited onto the first dielectric layer 16, so as to be positioned centrally with respect to the activation electrode 14 and the second dielectric layer 20. The contact electrode 18 is isolated from the actuation electrode 14 by the first dielectric layer 16. The contact electrode 18 is, in this embodiment, 2 micron wide.

At step s14, a sacrificial layer 22 is deposited over the contact electrode 18 to fill the area over the contact electrode 18 to the same height as that of the surrounding second dielectric layer 20.

At step s16, a metallic membrane 26 is deposited over the sacrificial layer 22 to cover the area filled by the sacrificial layer and at least part of second dielectric layer 20. The metallic membrane 26 is, in this embodiment, a 1 micron thick layer of aluminium.

At step s18, a hole 32 is formed in the centre of the metallic membrane 26 above the contact electrode 18.

At step s20, the sacrificial layer 22 is etched away through the hole 32 to leave a cavity 24. The radius of the diaphragm portion of the metallic membrane 26 over the cavity 24 is 25 micron.

At step s22, additional contact material 28 is deposited through the hole 32 in the metallic membrane 26 onto the contact electrode 18 on the opposite side of the cavity 24 to provide a dimple 28. In other words, the metallic membrane is used as a mask in step s22. The additional contact material comprises aluminium in this embodiment. This provision of the additional contact material 28 provides an improved localised contact whose portion is automatically aligned with the location of a top electrode to be described below. However, this provision of the additional contact material 28 is not essential, and in other embodiments step s22 may be omitted.

At step s24, the hole 32 in the metallic membrane 26 is plugged by filling it with a metallic material. The metallic material filling the hole 32 in the membrane 26 functions as a contact material. The metallic material thereby forms top electrode 30. The metallic material in this embodiment is aluminium. The hole 32 in the metallic membrane 26 is hermetically sealed in a vacuum atmosphere by filling it with the metallic material. Sealing the hole in a vacuum atmosphere forms a vacuum cavity 24 located between the metallic membrane 26, the first dielectric layer 16 and the second dielectric layer 20. The vacuum cavity 24 is formed in place of the sacrificial layer 22.

The distance or gap 42 between the lower surface of the top electrode 30 and the upper surface of the additional contact material 28 on the contact electrode 18 is, in this embodiment, in the order of 100 nm. The height 44 of the vacuum cavity 24, between the metallic membrane 26 and the first dielectric layer is, in this embodiment, 200 nm.

The total actuation gap of the switch is the sum of the height 40 of the portion of first dielectric layer 16 between the actuation electrode 14 and the vacuum cavity 24, here 400 nm, and height 44 of the vacuum cavity 24, here 200 nm, i.e. here is 600 nm.

Operation of the MEMS switch 1 will now be described. A DC actuation voltage $V_{act}$, of, for example 50V is applied to the actuation electrode 14 via the actuation voltage contact pad 50. When a DC voltage is applied between the actuation electrode 14 and the top electrode 30, the electrostatic force will pull the metallic membrane 26 down. The gap spacing between the metallic membrane 26 and the actuation electrode 14 is larger than that between the metallic membrane 26 and the contact electrode 18. Therefore the metallic membrane 26 will first touch the contact electrode 18 when it is actuated by voltage on the actuation electrode.

The contact force $F_{cont}$ between the metallic membrane 26 and the contact electrode for the MEMS switch of the preferred embodiment is 119 μN.

Further details concerning the principle of operation of the MEMS switch 1 together with examples of the performance characteristics of the present embodiment will now be described.

Three main factors determining the performance of a galvanic (RF) MEMS switch are: the available contact force $F_{cont}$, the restoring force $F_{restore}$ and the electrical resistance R. The relationship between the contact and restoring forces, $F_{cont}$, and $F_{restore}$ is important to the function of the switch as explained below.

Three forces play a role in electrostatic actuated galvanic MEMS switches: the electrostatic force $F_{el}$, the force exerted by the anchors on the spring $F_{spring}$ and the contact force $F_{cont}$. In equilibrium the sum of these forces should be zero. Since the electrostatic force is usually downward and the contact and spring forces are upward we have:

$$F_{el}=F_{spring}+F_{cont} \tag{1}$$

When the switch is opening, the electrostatic force is zero and a negative contact force, also called restoring force $F_{restore}=F_{spring}=-F_{cont}$ is generated to separate the galvanic electrodes from each other. Thus we obtain that for an optimal design we have:

$$F_{el,max}=F_{restore}+F_{cont} \tag{2}$$

For a high reliability of the switch it is required that both $F_{cont}$ and $F_{restore}$ are sufficiently high, because a high $F_{cont}$ will provide a low resistance contact and a high $F_{restore}$ will prevent sticking and arcing of the switch. Equation (2) indicates that, for a fixed maximum available electrostatic force, a trade-off exists between the restoring and contact force, their sum remaining constant. A rough rule of thumb for a good reliability of the galvanic contact is that $F_{restore}>F_{cont}/3$ and $F_{cont}>100$ μN.

When reducing the switch size it is possible to keep the electrostatic force equal by reducing the electrostatic gap at the same rate as the area of the switch. Thus it is possible to keep the sum of $F_{restore}$ and $F_{cont}$ in equation (2) constant. However for very small MEMS switches it becomes increasingly difficult to generate enough restoring force $F_{restore}$ without plasticly deforming the springs. If the stresses in the spring exceed the yield stress, plastic deformation will occur. It can be shown that for a bending spring with a fixed composition, area and thickness, the ratio between restoring force and maximum anchor stress $F_{restore}/\sigma_{max,anchor}$ is maximal for a circular membrane. Therefore we find that for small switches, the optimal design, which generates the maximum restoring force, is a circular membrane. Its spring constant k and ratio $F_{restore}/\sigma_{max}$ are given by:

$$k = \frac{4\pi E t^3}{3R(1-\nu^2)}$$

$$F_{restore}/\sigma_{max,anchor} = \frac{2\pi t^2}{3}$$

Note that some plastic deformation near the central contact might occur before deformations will occur at the anchors, but these will have a much smaller effect on the total spring shape. These central deformations can be reduced by locally increasing the membrane thickness near the centre.

As regards resistance R, the total resistance of the switch includes, in addition to the contact resistance, the resistance of the metallic interconnect lines, $R_{interconnect}$.

The resistance of a membrane switch is minimized if the full membrane is metallized. Moreover, it is preferable to have a membrane that consists of only one material, because differences in thermal expansion coefficient will tend to cause problems at elevated temperatures (the membrane would bend like a bimetal element). Therefore in this embodiment a membrane of a single layer of metal is used.

Figure 4:
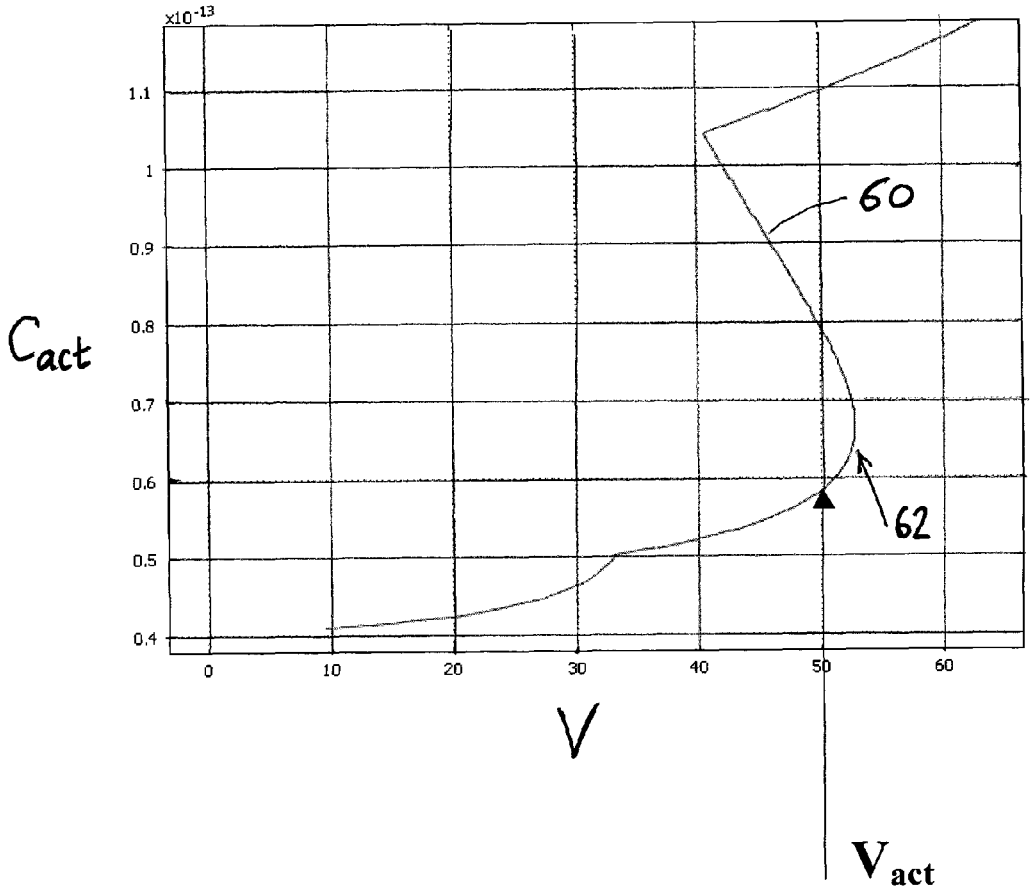
FIG. 4 shows a curve of the relationship between the actuation capacitance $C_{act}$ of the switch and the voltage V across the MEMS switch of FIG. 1.
Figure 5:
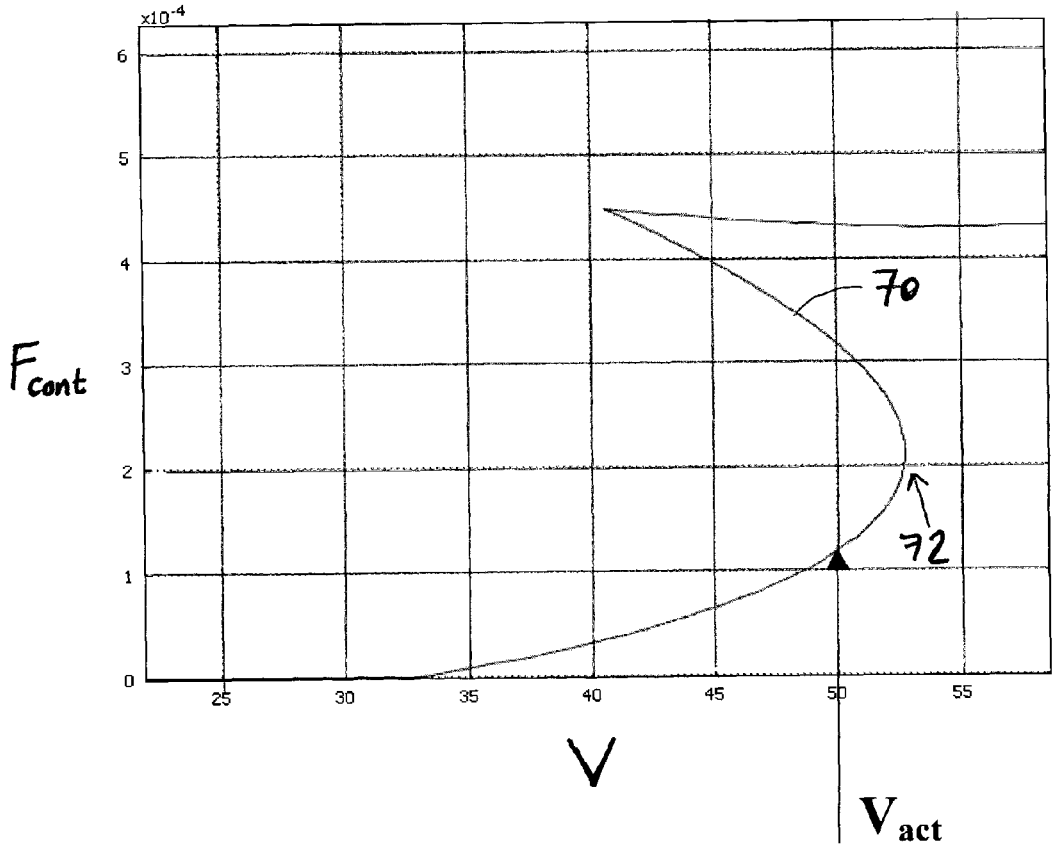
FIG. 5 shows a curve of the relationship between the contact force $F_{cont}$ of the switch and the voltage V across the MEMS switch of FIG. 1.

FIGS. 4 and 5 show certain aspects of the MEMS switch 1 and its operation in more detail. The metallic membrane 26 material is 1 μm Al. The gap between the contacts is 100 nm, and the gap between the actuation electrode and the metallic membrane 26 is 200 nm vacuum+400 nm SiN. The radius of the metallic membrane 26 is 25 μm.

FIG. 4 shows a curve (indicated by reference numeral 60) of the relationship between the actuation capacitance $C_{act}$ of the switch and the voltage V across the MEMS switch 1. FIG. 5 shows a curve (indicated by reference numeral 70) of the relationship between the contact force $F_{cont}$ of the switch and the voltage V across the MEMS switch 1. As can be seen from both the $C_{act}$-V curve 60 and the $F_{cont}$-V curve 70, the contacts touch at around 33V. If the voltage is increased the contact force rises. Around 52V, pull-in of the metallic membrane 26 occurs (as indicated by the reference numerals 62 and 72 in FIGS. 4 and 5 respectively) and the contact force increases from 200 μN to 420 μN. It is preferable to operate the switch in the region before pull-in of the actuation electrode. This prevents charging and prevents discontinuities in the contact position and resistance which might occur at pull-in. Thus in this example the actuation voltage ($V_{act}$) is 50V as shown in FIGS. 4 and 5.

The following is a summary of the calculated parameters for this embodiment:

$F_{cont}$=119 μN @ 50V $V_{act}$=50V $F_{restoring}$=48μN=Force to release the Switch $R_{interconnect}$=~0.2 Ohm/switch (for $t_{bottom}=t_{top}$=1 μm)

$R_{total}=R_{interconnect}+R_{cont}$=0.2+0.1=~0.3 Ohm

Contact capacitance Coff=~1 fF (without substrate parasitics, for a contact radius of 3 μm).

Membrane area ~$25^2\pi$=2000 $\mu m^2$

Maximum von Mises stress: 80 MPa

Buckling temperature of metallic membrane ~ΔT~50C

Figure 6:
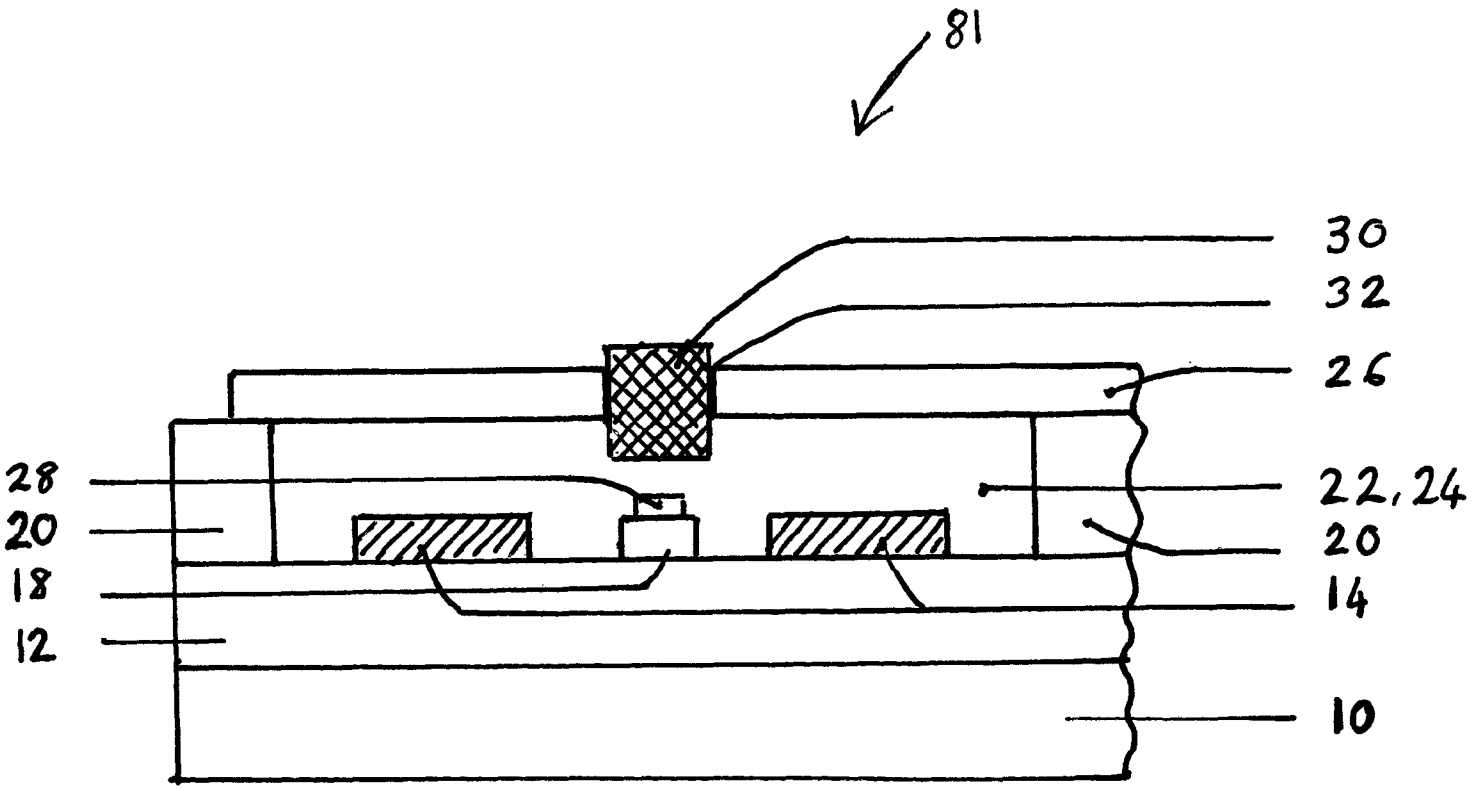
FIG. 6 is a schematic cross-section (not to scale) of a further example of a galvanic (RF) MEMS switch.

FIG. 6 is a schematic cross-section (not to scale) of a further embodiment of galvanic (RF) MEMS switch 81. The same reference numerals have been used to features which are the same as those depicted in FIG. 1.

The MEMS switch 81 comprises a substrate 10, an isolating layer 12 and an actuation electrode 14. The MEMS switch 81 further comprises a contact electrode 18 provided on the isolating layer 12. A dielectric layer 20 is provided at the outer edges of the device on isolating layer 12. The contact electrode 18 is positioned centrally. Additional contact material 28 is provided on the contact electrode 18 in the form of a metallic dimple 28 positioned over the contact electrode 18.

The MEMS switch 81 further comprises a metallic membrane 26 positioned over the dielectric layer 20 and the contact electrode 18 thereby forming a cavity 24. The cavity 24 lies between the metallic membrane 26, the isolating layer 12 and the dielectric layer 20 and surrounds the isolating layer 12 and the contact electrode 18.

The metallic membrane 26 has a hole 32 provided within it which is filled with metallic material. The metallic material filling the hole 32 forms a top electrode 30. The top electrode 30 is positioned directly above and spaced apart from the contact electrode 18.

The membrane is made of metal or metal alloy, hence the electrical resistance of the switch is reduced compared to prior art membranes. Furthermore the membrane consists of a single material i.e. a layer of a single type of metal or metal alloy, which therefore has a single coefficient of expansion, thereby alleviating potential problems at high temperatures caused by differences in the thermal expansion co-efficient.

In the same way as for the MEMS switch 1, the MEMS switch 81 is also shown in more detail in the plan view of FIG. 2. FIG. 2 shows the following features already shown in FIG. 6: the actuation electrode 14, the cavity 24, the metallic membrane 26 and the top electrode 30. As with the MEMS switch 1 of FIG. 1, the actuation electrode 14, the contact area of the top electrode 30 and the cavity 24 of the MEMS switch 81 shown in FIG. 6 also each have a circular form. Again, as for MEMS switch 1, for the MEMS switch 81, a circular diaphragm which acts as the moving structure is formed by the metallic membrane 26 sealed by the dielectric layer 20 around the circumference of cavity 24. Thus, the actuation electrode 14 of FIG. 6 is a single structure and, in the same way as for FIG. 1, FIG. 6 illustrates two cross-section portions of the same single structure actuation electrode 14.

The MEMS switch 81 is powered via an actuation voltage contact pad 50, an actuation voltage connector 52, a power output connector 54 and a power output contact pad 56 in the same way as the MEMS switch 1 as illustrated in FIG. 2.

The MEMS switch 81 of this embodiment may be manufactured by the same process as described above with regard to FIG. 3, except that the step s8 of depositing the first dielectric layer 16 is omitted.

Again it should be noted that terminology such as top, over and above are used for the purposes of explaining the features of the present embodiment in accordance with the illustration and are not intended to limit the orientation of the device.

In the above described embodiments, the MEMS switch is a galvanic (RF) switch. However, in other embodiments other forms of MEMS switches may be implemented. For example, the MEMS switch can be any type of electrostatically actuated MEMS switch.

The substrate 10 and the isolating layer 12 can be any suitable insulating material compatible with MEMS device manufacturing processes. For example, suitable substrates and isolating layers can include SiO. The substrate 10 can be an insulating material such as glass, $SiO_2$ or sapphire; in these cases the isolating layer 12 can be omitted. Another possibility is that the substrate 10 can be a semiconductor, for example Si. When the substrate 10 is a semiconductor, the isolating layer 12 can be SiN, SiO, $Al_2O_3$, $ZrO_2$ or MgO, for example.

The dielectric layers 16 and 20 can be any suitable dielectric material compatible with MEMS device manufacturing processes. For example, suitable dielectric materials can include SiN or SiO.

For dielectric layer 16 it can be advantageous to use a high dielectric constant material such as $Al_2O_3$, $HfO_2$, $Ba_xSr_{1-x}TiO_3$ or $Pb_{1-x}La_x(Zr_yTi_{1-y})_{1-z}O_3$. For dielectric layer 20 it can be advantageous to use a low dielectric constant material, for example carbon doped $SiO_2$, or porous $SiO_2$ or polymeric organic dielectrics.

As can be seen by comparing FIG. 1 and FIG. 6, not all layers are essential to the performance of the invention. For example, in the embodiment as shown in FIG. 6, the first dielectric layer 16 of FIG. 1 is omitted.

The order of deposition of the layers and the electrodes may also vary. For example, it would be possible to perform step s12 of FIG. 3 before step s10, i.e. for the FIG. 1 embodiment, deposit contact electrode 18 before depositing second dielectric layer 20. Similarly for the FIG. 6 embodiment, actuation electrode 14 and contact electrode 18 could be deposited in the same step or in separate steps and this step or steps could occur before or after the step of depositing dielectric layer 20.

In the above described embodiments, the cavity 24 and the diaphragm portion of the metallic membrane 26 sealing the cavity 24, and forming the actuation structure of the MEMS switch 1 are circular, as can be seen in FIG. 2. However, other shapes of cavity and diaphragm portion of metallic membrane 26 may be implemented. For example, oval or other elliptical shapes, or polygons such as squares, rectangles, hexagons may be used. The actuation electrode 14 may also vary in shape, for example, to correspond to any shape of the cavity 24 and/or the diaphragm portion of the metallic membrane 26.

In the above described embodiments, the additional contact material 28 is provided on contact electrode 18 through the hole 32 in the form of a dimple 28. This step is not essential to the performance of the invention. Optionally the contact electrode 18 can have no additional contact material 28. As an alternative, the top electrode 30 metallic material filling the hole 32 in the metallic membrane 26 can be provided with an additional contact material in the form of a dimple. Alternatively both the contact electrode 18 and the top electrode 30 can be provided with additional contact material. Instead of providing additional material it is also possible to create a dimple by locally deforming the height profile of the metallic membrane 26. This can for example be achieved by depositing the metallic membrane 26 on top of a sacrificial layer 22 which has been made with a non-uniform thickness. The non-uniform thickness of the sacrificial layer 22 can be achieved, for example, by depositing the sacrificial layer 22 in two steps, where after the first deposition step a small hole is created in the sacrificial layer before depositing the second layer.

In further embodiments the metallic membrane 26 is corrugated to vary its spring constant. In other words, the corrugation can be specified to provide a desired spring constant. This possibility provides an advantageous way of specifying the spring constant of the membrane of a MEMS switch. One way of providing the corrugations is to vary the thickness of the sacrificial layer before depositing the metallic membrane on the sacrificial layer. This can be done, for example, by depositing the sacrificial layer 22 in two steps.

Irrespective of whether additional contact material is provided on one or both or neither of the electrodes, what is preferred is that the gap 42 between the metallic membrane 26 and the contact electrode 18 is smaller than the gap 46 between the metallic membrane 26 and the actuation electrode 14.

In the above described embodiments, the metallic membrane 26 thickness is 1 μm. However, metallic membrane 26 of other thicknesses may be used. For example, because plastic deformation near the central contact occurs before deformations occur at the circumferential seal or spring anchor, if desired, these central deformations can be reduced by locally increasing the metallic membrane 26 thickness near the centre.

In the above described embodiments, the hole 32 in the metallic membrane 26 is positioned centrally with respect to the diaphragm portion of the membrane 26. Similarly, the contact electrode 18 is positioned centrally in the cavity 24, directly under the filled hole 32.

The central position of the hole 32 provides for improved etching of the sacrificial layer 22 and improved deposition of the additional contact material 28. This position is not essential however. For example, the hole 32 may be positioned off-centre relative to the cavity 24. In the case that the hole 32 is positioned off-centre relative to the cavity 24, the contact electrode 18 and the additional contact material 28, if present, may usefully be located directly under the hole 32.

Although in the above described embodiments, the metallic membrane 26, the additional contact material and the metallic material filling the hole 32 in the metallic membrane 26 comprise aluminium, other suitable alloys of aluminium or other suitable conducting materials may be used. For example one or more of the metallic membrane 26, the additional contact material and the metallic material filling the hole 32 in the metallic membrane 26 may comprise Au, Ni, Pt, TiN or alloys thereof.

Although in the above described embodiments, the cavity 24 is sealed by filling the hole 32 in the metallic membrane 26 in a vacuum, the cavity may be formed by sealing in other inert gas or even in air.

In the above described embodiments the actuation voltage $V_{act}$ is given as 50V, for an actuation gap, (i.e. the gap between the contact material 28 and the top electrode 30) of 100 nm and a metallic membrane thickness of 1 μm. It is to be understood, however, that values of actuation voltage $V_{act}$, actuation gap, metallic membrane thickness and other dimensions of electrodes or heights can be varied as appropriate to achieve the desired functionality of the MEMS switch.

Advantages of the circular metallic membrane MEMS switch arrangement compared to prior art galvanic MEMS switches tend to include one or more of the following:

- Large mechanical restoring force at the contact: if adhesion forces are present a large restoring force is required to release the structure. On the other hand, the stresses in the structure should not exceed the yield stress of the metallic membrane material. For a metal with a fixed thickness, the circular metallic membrane structure can generate the largest restoring force at a fixed maximum stress level.
- Small ratio between circumference and area: if a package ring is required the area increase is minimal.

Advantages of Etching and Sealing Method—i.e. advantages of forming the additional contacts and sealing the vacuum cavity through a hole in the metallic membrane:

- Improved ease of etching out the cavity 24: removing the sacrificial layer 22 through the hole 32 permits an improved seal. Furthermore, removing the sacrificial layer 22 through the hole 32 also tends to ensure improved removal of the material around the contact electrode 18 to ensure good connectivity.
- The improved etching method also tends to reduce damage to the actuation electrode 14 while removing the sacrificial layer 22.
- For the FIG. 6 embodiment, removing the sacrificial layer 22 through the hole 32 also tends to provide improved removal of the material around the actuation electrode 14 to provide good operability of the switch.
- For the FIG. 6 embodiment, the improved etching method also tends to reduce damage to the actuation electrode 14 while removing the sacrificial layer 22.
- Improved ease of sealing of the cavity: the cavity below the metallic membrane can be sealed in a vacuum or inert gas. This will tend to prevent contaminant gases from reaching the contact area and will thus improve the contact reliability. Calculations show that a 1 bar pressure will deform the switch in the implementation example by only 10 nm, so it can easily sustain air pressure. Such a vacuum seal might also simplify the further packaging flow.
- Where the plugging material that seals the cavity 24 also functions as dedicated contact material to form a good galvanic contact, the inventors have realised that it is advantageous to deposit this material towards the end of the fabrication process. The reason that this method is an improvement to existing methods is that contact materials are usually not compatible with standard (CMOS) manufacturing equipment. After depositing the contact material, further processing steps can therefore usually not be performed in a standard factory. This processing flow allows integration of the switch on CMOS chips.

Typical manufacturing requirements for galvanic (RF) MEMS switches include small size, mass-produciblility, high reliability and good energy efficiency. The above embodiments provide a MEMS switch structure comprising a metallic membrane as the moving structure to provide a highly reliable and efficient MEMS switch, for example a galvanic (RF) MEMS switch. Advantageously, the above described fabrication processes for the above described MEMS switches are able to use a single wafer structure.

In the above embodiments the MEMS switch is a galvanic (RF) MEMS switch, the term "RF" signifying that the switch may be used to switch DC and/or RF. However, in further embodiments, the switch is solely for use as a switch for DC, and in yet further embodiments the switch is solely for use as a switch for RF.

In the above embodiments the MEMS switch is an electrostatic actuated MEMS switch. However in other embodiments, the MEMS switch may be actuated by other means, for example by piezoelectric actuation or by thermal actuation.

In the above embodiments, due to the gap in the actuation electrode 14 to allow connection between the top electrode 30 and the power output contact pad 56 (which connection is part of/in the direction of what may be referred to as the "RF line"), there is a reduction in actuation area, hence either or both of the touch-down and the pull-in voltage increases compared to a fully symmetrical case. In order to alleviate this, in further embodiments, the above embodiments are adapted to provide a higher bending stiffness along the RF line e.g. along the line between the top electrode 30 and the power output contact pad 56 than along the line perpendicular to the RF line. This may be implemented in any appropriate fashion.

FIG. 7 which is a schematic plan view (not to scale) of an MEMS switch of a further embodiment. The component parts are the same as, and are indicated by the same reference numerals, as for the MEMS switches 1 and 81 shown in FIG. 2. In this embodiment, a higher bending stiffness along the RF line 102 (i.e. along the line between the top electrode 30 and the power output contact pad 56) than along a perpendicular line 104, i.e. a line perpendicular to the RF line 102, is implemented by providing a non-symmetrical shape to the metallic membrane 26 (i.e. to the outer perimeter 106 of the cavity 24). In this embodiment an elliptical shape rather than a circular shape, with the long-axis of the ellipse along the RF line 102, is used. In this embodiment the outer perimeter of the cavity 24 is in the shape of an ellipse with a semi-axis of 50 μm in the direction of the RF line 102 and a semi-axis of 35 μm in the direction of the perpendicular line 104.

This embodiment and other embodiments providing a higher bending may be further appreciated by the following description.

In the earlier embodiments described with reference to FIGS. 1-6, the actuation electrode is not fully rotational symmetric due to the fact that room has to be spared for the RF in and RF out line. The present inventors have realised this has a number of potential effects:

Due to a reduction in the actuation area, both the touch-down and the pull-in voltage increase when compared to the fully axial symmetric case.

Along the RF line there is typically nearly no top electrode material connected to the membrane. The membrane is thus easier to bend along this line. The membrane displacement is thus not fully rotational symmetric. This is illustrated in FIG. 8, where height contours are plotted at the moment of touch-down. In more detail, FIG. 8 is a top view of a finite element model of the galvanic MEMS switch such as that of FIG. 1 at touch-down (quarter symmetry is used). The lines are contour lines of points of equal height and have an elliptical shape. For ease of comparison, two dotted quarter-circles are also drawn. Labels A and B indicate the semi-axes of the circular membrane.

The unsymmetric stiffness and actuation properties of the membrane result in elliptically shaped height contours. In FIG. 9, a schematic representation of the displacement along the semi-axes of FIG. 8 is given.

As a result of this displacement shape, the relative increase in the pull-in voltage compared to the touch-down voltage is lower, causing a decrease in the working range. This problem is especially problematic for small devices where the RF lines form a large part of the total membrane area.

In FIG. 10, the working range is shown as a function of the membrane radius. The outer radius of the actuation electrode is also increased so that the offset to the membrane radius is constant. All other design parameters, including the widths of the tapered RF lines remain constant (their heights should also be scaled with the membrane radius).

The effect of the tapered RF lines on the working range of small devices is apparent in FIG. 10. For larger devices, the membrane stiffness decreases, causing a decrease in the working range. Therefore, FIG. 10 shows an optimum.

From the Finite Element simulations, also a maximum achievable contact force can be calculated. This is the contact force just before pull-in and is given in FIG. 11. In FIG. 12, the maximum contact force is plotted against the working range, showing a clear correlation between the two.

The present inventors have thus envisaged the following problems that they have addressed with the further embodiment of FIG. 7 (and further associated embodiments discussed later below):

Due to a decrease in actuation area, the touch-down voltage increases with a larger risk for electrical breakdown as a result.

Due to the unsymmetric stiffness and actuation properties of the switch, the pull-in voltage shows a relatively smaller increase.

Consequently, the working range and maximum achievable contact force is decreased. The main issue here will be that the contact resistance decreases.

In the embodiment of FIG. 7, and further associated embodiments discussed later below, the bending stiffness of the galvanic switch has been adapted in such a way that the bending stiffness along the RF line is higher than the bending stiffness along the line perpendicular to the RF line.

In the embodiment of FIG. 7, the membrane shape is changed from circular to elliptical. This tends to provide one or more of the following advantages:

By increasing the semi-axis along the RF line, the membrane stiffness is decreased, causing a lowering of the touch-down voltage.

At the same time, the elliptical shaped membrane causes a more symmetrical displacement profile. This results in a decrease of the pull-in voltage that is relatively smaller than decrease of the touch-down voltage. The working range is, in other words, increased.

Consequently, the maximum achievable contact force increases.

Furthermore, the slope of the contact force as a function of the applied voltage ($dF_c/dV$), decreases. This can be envisioned as a more stable contact force. Small changes in the actuation voltage will cause smaller changes in the contact force and, logically, the contact resistance.

Finally, the elliptical design allows for an increase in restoring force and resonance frequency, while keeping the touch-down voltage constant.

This reduces the risk for arcing and stiction.

In this embodiment of the switch has an elliptically shaped membrane (i.e. elliptically shaped outer perimeter 106 of the cavity 24), with one semi-axis of 35 μm, and one of 50 μm. FIG. 13 shows a top view of a finite element model of this embodiment at touch-down (quarter symmetry is used). The lines are contour lines of points of equal height. For ease of comparison, two dotted quarter-circles are also drawn.

When compared to FIG. 8, a change in the deflection profile is seen.

Table 1 shows device properties of a circular galvanic switch and various elliptical devices, as simulated with the Finite Element tool Comsol. In Table 1, the results of various elliptical membranes are summarized and compared to a standard circular reference device with a radius of 35 μm. This reference device has optimum values of the working range and contact force for circular devices (see FIGS. 10 and 11). It should be noted that no attempt has been made to optimize the elliptical membrane devices. However, even without optimization, the benefits are evident. Contact forces can be increased while the touch-down voltage can be lowered. If we allowed for smaller contact forces (for example because they have already proven to be large enough), even lower touch-down voltages would be achieved (see final row in Table 1).

TABLE 1

| r (r1/r2) [um] | $V_{touch}$ [V] | $V_{pull\text{-}in}$ [V] | Range [V] | $F_{c,max}$ [uN] | $F_{release}$ [uN] |
|---|---|---|---|---|---|
| 35 | 59.2 | 64.6 | 5.4 | 68.4 | 161.2 |
| 35/50 | 43.7 | 51.3 | 7.6 | 96.7 | 127.2 |
| 35/60 | 40.3 | 47.6 | 7.3 | 95.2 | 121.6 |
| 35/70 | 38.1 | 45.1 | 7.0 | 92.4 | 118.4 |
| 45/50 | 28.7 | 34.1 | 5.4 | 71.1 | 89.8 |

The present discussion of potential benefits of this embodiment has mostly concentrated on comparing devices with one equal semi-axis. Another comparison can be made when we compare devices with equal membrane area and thus approximately equal actuation area. To this end, we define the equivalent radius $r_{eq}$. This is the radius of a circular membrane with an area equal to an elliptical membrane with semi-axes $r_1$ and $r_2$:

$$r_{eq}=r_1 r_2 \tag{1}$$

For $r_1$=35 um and $r_2$=60 um, $r_{eq}$=45.8 um. Similarly, for $r_1$=40 um and $r_2$=50 um, $r_{eq}$=44.7 um. For reasons of simplicity, we will compare the two elliptical cases with the circular case of 45 μm in Table 2 below, where Table 2 shows device properties of a circular galvanic switch and two elliptical devices, with comparable membrane and actuation electrode size, as simulated with the Finite Element tool Comsol.

TABLE 2

| r (r1/r2) [um] | $V_{touch}$ [V] | $V_{pull\text{-}in}$ [V] | Range [V] | $F_{c,max}$ [uN] | $F_{release}$ [uN] |
|---|---|---|---|---|---|
| 45 | 31.7 | 36.6 | 4.9 | 67.4 | 97.2 |
| 40/50 | 34.6 | 41.0 | 6.4 | 78.4 | 104.2 |
| 35/60 | 40.3 | 47.6 | 7.3 | 95.2 | 121.6 |

For an elliptical membrane, its stiffness k to a uniform distributed load, increases for increasing ratio $\alpha=r_2/r_1$ between the semi-axis:

$$k_{circular} \propto \frac{64}{r^4} \qquad k_{elliptical} \propto \frac{24+16\alpha^2+24\alpha^4}{\alpha^4}\frac{1}{r_1^4} \tag{2}$$

Therefore, the touch-down voltages and pull-in voltages of the elliptical membranes in Table 2 are higher than the ones of the circular membrane. As a result, also the maximum contact force and restoring force are higher.

It is not only of interest how large the actuation area is (because the areas are approximately equal in size in Table 2), but also how the area is positioned in relation to the stiffness properties of the membrane.

As already mentioned, the contact force also becomes more stable in the elliptical situation. This has a direct effect on the stability of the contact resistance on the actuation voltage. FIG. 14 shows contact force $F_c$ (per dimple) as a function of the actuation voltage V for a circular and elliptical membrane. Dashed lines indicate the slope $dF_c/dV$ in an operating point of 40 uN. In FIG. 14, the contact force is plotted as a function of the actuation voltage for a circular and elliptical membrane. We can see that the elliptical membrane has a lower $dF_c/dV$.

Another implication of the increased stiffness of the elliptical membrane compared to the circular membrane with equal area, is the increase in the resonance frequency. In the literature, e.g. W. Leissa, *Vibration of Plates*, Scientific and Technical Information Division NASA, Washington D.C., 1969, the fundamental resonance frequency of a circular and elliptical membrane are given by:

$$f_{circular} \propto \frac{10.217}{r^2} \qquad f_{elliptical} \propto \frac{\lambda^2}{r_2^2} \tag{3}$$

with $\lambda^2$ depending on the ratio $r_2/r_1$. For example, $\lambda^2$=10.217 when $r_2/r_1$=1 and $\lambda^2$=17.025 when $r_2/r_1$=1.5. Due to the higher stiffness and resonance frequency, the elliptical switch will close slower than the circular one (at the same value of the actuation voltage). However, in practice, this is usually not a problem because MEMS switches usually close much faster than they open. The main advantage of the higher resonance frequency of the elliptical membrane is that the opening will occur faster. This is very beneficial to reduce the probability of the formation of current arcs across the gap.

As is the case with the circular membrane, the outer boundary of the elliptical membrane does not have (sharp) corners. This reduces the risk of high stress concentrations and structural damage.

Further associated embodiments are as follows:

Using a rectangular shaped membrane of which the longest side is parallel to the RF line. The typical effect of such an embodiment is shown in FIG. 15, where FIG. 15 is a top view of a finite element model of a rectangular galvanic MEMS switch at touch-down (quarter symmetry is used). Total membrane size is 70×80 μm. The lines are contour lines of points of equal height. Table 3 below shows device properties of a circular, elliptical and rectangular galvanic switch, as simulated with the finite element tool Comsol. As summarized in Table 3, a rectangular shaped membrane also shows an improvement compared to the circular membrane switch. Membrane corners can be rounded to avoid high stress concentrations.

Increasing the stiffness along the RF line by placing extra material in the structural layer or by forming dummy floating metal pads in the top electrode layer.

A combination of the above described associated embodiments.

TABLE 3

| Size [um] | $V_{touch}$ [V] | $V_{pull\text{-}in}$ [V] | Range [V] | $F_{c,max}$ [uN] | $F_{release}$ [uN] |
|---|---|---|---|---|---|
| r = 35 circular | 59.2 | 64.6 | 5.4 | 68.4 | 161.2 |
| r = 35/50 ellipt. | 43.7 | 51.3 | 7.6 | 96.7 | 127.2 |
| 70/100 rect. | 38.4 | 45.5 | 7.1 | 94.1 | 116.7 |

Thus to summarise, in the embodiment of FIG. 7, and associated further embodiments discussed above, the bending stiffness along the RF line of a MEMS galvanic switch is made to be higher than the bending stiffness along a line perpendicular to the RF line. For one possible embodiment, an elliptical membrane, it is shown above that an extra design degree of freedom is provided that allows tailoring of the properties of the devices. By adapting the stiffness and actuation properties along the two semi-axes a situation can be achieved in which the touch-down voltage can be interchanged with the working range, contact force, release force, and resonance frequency:

For a comparable touch-down voltage, the working range, contact force (stability), release force, and resonance frequency can be increased with an elliptical membrane.

For a comparable working range and contact force, the touch-down voltage can be lowered for an elliptical membrane.

Such embodiments will, therefore, tend to be more robust to electrical breakdown, arcing and stiction, and will exhibit a lower electrical resistance. As for the circular membrane, the elliptical membrane has no (sharp) corners, reducing the risk of high stress concentrations and structural damage. Alternative embodiments include a rectangular membrane and the addition of structural stiffness by placing extra material in the structural or top electrode layer.

The embodiment of FIG. 7, and associated embodiments described thereafter, have been described in relation to the particular metallic membrane of the type comprised by the devices described with reference to FIGS. 1, 2 and 6. However, in other embodiments, the bending stiffness along the RF line of a MEMS galvanic switch is made to be higher than the bending stiffness along a line perpendicular to the RF line in any other appropriate type of MEMS switch comprising an appropriate membrane, i.e. for membranes other than metallic membranes of the type described with reference to FIGS. 1, 2 and 6, and also for other arrangements of cavities, membrane support, etc.

Thus it will be appreciated that in yet further embodiments, the only limitations particularly required are as follows:

A MEMS galvanic switch consisting of a membrane clamped at its outer perimeter;

Containing an RF in and RF out line that provide an RF line;

Containing an upper actuation electrode at each side of this RF line;

Of which the membrane stiffness is adapted such that the bending stiffness along the RF line is higher than the bending stiffness along the line perpendicular to the RF line.

The invention claimed is:

1. A MEMS switch comprising:

a substrate;

a first electrode on the substrate;

a dielectric layer on the substrate and covering the first electrode;

a second electrode on the dielectric layer and positioned both above and laterally between respective portions of the first electrode;

dielectric support structures on the first dielectric layer, the first and second electrodes being laterally between the dielectric support structures;

a sealed cavity; and a metallic membrane in contact with and supported by the dielectric support structures, the metallic membrane having a third electrode over the second electrode and being configured and arranged with the dielectric layer and the dielectric support structures to define the sealed cavity, the first electrode being configured and arranged to apply an electrostatic force to move the metallic membrane and cause the second and third electrodes to selectively contact and break contact in response to a voltage applied to the first electrode.

2. A MEMS switch according to claim 1, wherein the metallic membrane consists of one of a single type of metal and a metal alloy.

3. A MEMS switch according to claim 1, wherein the third electrode is located in a hole in a portion of the metallic membrane having upper and lower surfaces, the third electrode extending below the lower surface.

4. A MEMS switch according to claim 1, wherein a bending stiffness of the metallic membrane is higher along an RF line than along a line perpendicular to the RF line.

5. A MEMS switch according to claim 4, wherein the bending stiffness of the metallic membrane is higher along the RF line than along the line perpendicular to the RF line by virtue of the cavity being elliptical.

6. A MEMS switch according to claim 1, wherein the metallic membrane is corrugated.

7. A method of fabricating a MEMS switch, the method comprising:

providing a substrate;

providing a first electrode on the substrate;

providing a dielectric layer on the substrate and covering the first electrode;

providing a second electrode on the dielectric layer and positioned both above and laterally between respective portions of the first electrode;

providing dielectric support structures on the first dielectric layer, the first and second electrodes being laterally between the dielectric support structures;

providing a metallic membrane in contact with and supported by the dielectric support structures, the metallic membrane having a third electrode over the second electrode and being arranged with the dielectric layer and the dielectric support structures to define a sealed cavity, the first electrode being configured and arranged to apply an electrostatic force to move the metallic membrane and cause the second and third electrodes to selectively contact and break contact in response to a voltage applied to the first electrode.

8. A method according to claim 7, wherein the step of sealing the hole comprises sealing the hole with a material that provides a top electrode for the MEMS switch.

9. A method according to claim 7, the method further comprising:

prior to the sealing step, depositing, through the hole, a contact material to a contact provided on an opposite side of the cavity, the depositing step thereby using the metallic membrane as a mask.

10. A method according to claim 7, wherein a bending stiffness of the metallic membrane is higher along an RF line than along a line perpendicular to the RF line.

11. A method according to claim 10, wherein the bending stiffness of the metallic membrane is higher along the RF line than along the line perpendicular to the RF line by virtue of the cavity being elliptical.

12. A method according to claim 7, wherein the metallic membrane is corrugated with a plurality of corrugations.

13. A method according to claim 12, wherein the corrugations in the metallic membrane are provided by varying a thickness of the sacrificial layer in the step of providing the sacrificial layer.

14. A MEMS switch, comprising:

a membrane clamped at its outer perimeter and suspended over a cavity;

an RF line;

an actuation electrode configured and arranged at two sides or more of the RF line; and wherein a bending stiffness of the membrane is higher along the RF line than along a line perpendicular to the RF line.

15. A MEMS switch according to claim 14, wherein the bending stiffness of the membrane is higher along the RF line than along the line perpendicular to the RF line by virtue of the outer perimeter of the membrane being elliptical.

16. A MEMS switch according to claim 14, wherein the cavity is elliptical, the membrane is metallic and configured and arranged with the cavity to exhibit a bending stiffness that is higher along the RF line than along the line perpendicular to the RF line by virtue of the cavity being elliptical.

17. A MEMS switch according to claim 16, wherein the metallic membrane is corrugated with a plurality of corrugations.

18. A MEMS switch according to claim 17, wherein the corrugations in the metallic membrane are provided with etched portions of the metallic membrane at a surface level thereof with at least one thickness adjacent an etched portion of the metallic membrane.

19. A MEMS switch according to claim 18, further comprising: a top electrode located in a hole in the metallic membrane.

20. A MEMS switch according to claim 14, wherein the cavity is elliptical, the membrane is a metallic membrane that consists of one of a single type of metal and a metal alloy, and is configured and arranged with the cavity to exhibit a bending stiffness that is higher along the RF line than along the line perpendicular to the RF line by virtue of the cavity being elliptical.

* * * * *